US005844162A

United States Patent [19]

Renner

[11] Patent Number: 5,844,162

[45] Date of Patent: Dec. 1, 1998

[54] MUZZLE VENTING IN MUZZLELOADING RIFLES

[76] Inventor: Roger J. Renner, P.O. Box 1473, Lake Oswego, Oreg. 97035

[21] Appl. No.: 614,484

[22] Filed: Mar. 13, 1996

[51] Int. Cl.[6] ..... F41A 21/00

[52] U.S. Cl. ..... 89/14.3; 42/51; 42/78

[58] Field of Search ..... 89/14.3; 42/51, 42/78, 90

[56] References Cited

U.S. PATENT DOCUMENTS

| | | | |
|---|---|---|---|
| 2,184,595 | 12/1939 | Hughes | 89/14.3 |
| 2,372,315 | 3/1945 | Catron | 89/14.3 |
| 3,367,055 | 2/1968 | Powell | 42/79 |
| 3,736,839 | 6/1973 | Childers | 89/128 |
| 4,353,181 | 10/1982 | Pedgonay | 42/78 |
| 4,546,564 | 10/1985 | A'Costa | 42/76 R |
| 5,010,676 | 4/1991 | Kennedy | 42/71.01 |
| 5,435,089 | 7/1995 | Rodney, Jr. | 42/51 |

*Primary Examiner*—Charles T. Jordan
*Assistant Examiner*—Meena Chelliah

[57] ABSTRACT

A muzzle-loading rifle having vents cut into the barrel near its muzzle. The rifling is timed with respect to the placement of the vents such that all vents are located within the rifling grooves. Depending on the number and size of the vents, the rifling grooves may be relatively wide and the rifling twist relatively slow to ensure that all vents remain in the rifling grooves.

20 Claims, 1 Drawing Sheet

MUZZLE VENTING IN MUZZLELOADING RIFLES

TECHNICAL FIELD

The invention relates generally to muzzleloading rifles, and more particularly to venting the barrel of a muzzleloading rifle to reduce recoil and to disperse smoke and noise.

BACKGROUND OF THE INVENTION

Muzzleloading rifles are experiencing a resurgence in popularity for a number of different reasons. For example, hunters using muzzleloading rifles may have better or longer seasons in which to hunt compared to hunters using cartridge ammunition. Black powder firearms are also subject to less federal regulation. There also has been a renewed interest in historic recreations of civil war battles and life in the "old west" for which muzzleloading rifles are props and part of the action. These reasons, along with the fun of shooting a muzzleloading rifle, are all factors in the popularity of muzzleloading rifles.

Muzzleloading rifles, however, are not without their problems. They are capable of generating a punishingly heavy recoil with their large calibers, charges, and bullets. Muzzleloading rifles also are capable of generating large clouds of smoke, thus their nickname of "smoke pole." Although the smoke may be annoying when target shooting or recreational "plinking," it can be dangerous during hunting when it obstructs the hunter's view of the game.

A firearm's recoil is caused not only by the reaction force from accelerating the bullet, but also from the jet action of the combustion gases. In fact, the jet action of the combustion gases causes a significant portion of the recoil. Venting combustion gases in a direction other than the shooting axis can significantly reduce recoil. As an added benefit, if the gases are vented in an upward direction, the resulting downward force can counteract muzzle rise. Locating the vents near the barrel's muzzle, or even beyond the muzzle using an expansion chamber, minimizes the vents' effect on the bullet's velocity.

Barrel venting has been used for some time to reduce recoil in firearms that shoot cartridge ammunition. These vents have been arranged in many different locations. Vents have been bored through a barrel near its muzzle and along the top of a barrel along its length. Vents have been located in an expansion chamber or multiple expansion chambers located beyond a barrel's muzzle or in a smooth bore portion of a barrel near its muzzle.

Nonetheless, because of their manner of loading and the type of ammunition and powder they use, barrel venting has not been safe for use in muzzleloading rifles. A muzzleloading rifle, as the name indicates, is loaded from its muzzle. That is, a bullet and a patch are rammed backward through the barrel from its muzzle to its breech. Any irregularity in the barrel rifling can catch and tear the patch. At a minimum, a torn patch will reduce the accuracy and performance of a muzzleloading rifle. At the other extreme, a torn patch can be deadly to the shooter, causing the barrel to bulge or even explode from high internal pressures.

If a straight row of vents is drilled in the barrel of a typical muzzleloading rifle, at least one of the vents would intersect the shoulder of a rifling land. The intersection would result in a sharp edge that could snag a patch.

Firearms that use cartridge ammunition are loaded from the breech end of the barrel and do not fire a patched, round ball and thus are not nearly as sensitive to slight irregularities in rifling.

Muzzleloading rifles use blackpowder to propel bullets. Not all of the blackpowder is guaranteed to burn completely inside the barrel; some burning embers can blast out of the muzzle. If a muzzleloading rifle's barrel were to have vents, some burning embers could exit the barrel through the vents. Any vents angled downward could direct burning embers into dry grass or leaves.

There are still other problems concerning the construction of a muzzleloading rifle with barrel vents. For the sake of easy and repeatable manufacturability, it is desired to locate barrel vents in regular and consistent locations on the barrel.

Furthermore, many muzzleloading rifles have octagonal barrels with eight sides or "flats." Aesthetics dictate locating vents on the barrel so that they have some sort of symmetry with respect to the flats.

What is needed is a muzzleloading rifle that uses barrel venting to decrease recoil and disperse smoke and sound, yet does so without risk of snagging a patch during loading or directing burning embers downward upon firing, that can be easily and repeatably manufactured and that preserves the aesthetics of a traditional muzzleloading rifle.

SUMMARY OF THE INVENTION

According to the present invention, the foregoing requirements and advantages are attained by a muzzleloading rifle having barrel vents and having its rifling oriented or "timed" such that rifling grooves entirely contain the vents' inner junction with the bore of the barrel.

The vents may be arranged in various locations on the barrel. Preferably, the vents are located near the muzzle to minimize their effect on muzzle velocity. A single vent, or single row of vents, can be located on the top of the barrel near the muzzle. By directing the combustion gases away from the shooting axis, the recoil is reduced. As an additional advantage, the resulting downward jet force counteracts muzzle rise.

Preferably, a pair of vents or rows of vents is arranged on both sides of the barrel. As with a single vent or row of vents, the recoil is reduced. However, by using multiple rows of vents, more gases can be vented, resulting in increased recoil reduction. Furthermore, by placing the vents on the sides, smoke is directed away from the shooter's line of sight. Preferably, the vents are arranged symmetrically on both sides of the barrel. By angling the vents upward, some downward force can be retained to counteract muzzle rise. To prevent burning embers from being blasted into dry grass or leaves, none of the vents should angle downward.

As a feature of the present invention, the vents can be arranged in straight rows along the longitudinal axis of the barrel. If the barrel has an octagonal exterior, the vents can be centered on the flats. These arrangements of vents simplify the repeatable manufacturability of the vents. They also preserve the aesthetics of a traditional muzzleloading rifle.

Prior to the present invention, the orientation of the rifling has not been considered to be an important factor. However, as an important element of the present invention, the vents must enter the bore of the barrel entirely within a rifling groove. It is desired to locate the vents or rows of vents at specific locations on the barrel. Thus, as a concomitant element of the present invention, the rifling must be timed such that grooves are present where the vents enter the bore.

To ease the timing requirements, or increase the contiguous length of the barrel in which vents can be located, or both, two variables may be varied. As a first feature, the rifling may be decreased to a much lower rate than is typically used in a muzzleloading rifle, for example, one turn in twelve feet. Such slow rifling can be used for muzzleloading rifles because very little spin is needed to stabilize a round ball bullet.

As a second feature, the lands can be made quite narrow with respect to the width of the grooves. Typically, lands and grooves are equal in width. This second feature can result in many other advantages. The friction between the barrel and bullet is decreased, thereby increasing muzzle velocity and decreasing pressure during firing. Powder fouling is also decreased.

As yet another a feature of the present invention, the vents may be angled backward to provide a forward component of force. This forward force further counteracts the backward force of recoil.

As a further advantage of the present invention, the vents of the present invention appear to scatter the blast, that is the sound, of firing a muzzleloading rifle. In experimental tests of prototypes while hunting, game appeared to be unable to detect the source of the sound and were thus not able to use the sound to detect the location of the hunter.

These and other features and advantages of the present invention will become apparent to those skilled in the art upon examination of the following specification when taken in conjunction with the drawings.

DETAILED DESCRIPTION OF THE INVENTION

Figure 1:
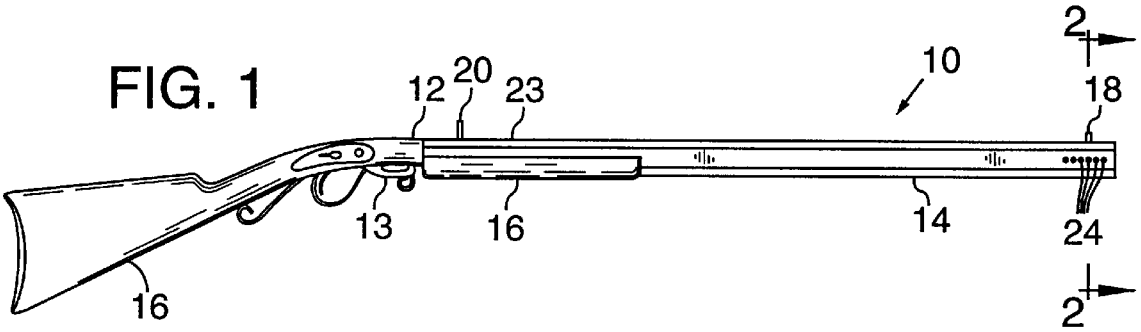
FIG. 1 is a side elevation view of a muzzleloading rifle incorporating muzzle venting according to the present invention.

Referring now to the drawings, wherein like reference numerals refer to like elements, and with specific attention first given to FIG. 1, a muzzleloading rifle 10 incorporating the present invention includes a receiver 12, a barrel 14, and stocks 16. As is typical for muzzle loading rifles 10, barrel 14 has an octagonal cross section. On the top of barrel 14 are a front sight 18 and a rear sight 20 to aid in aiming rifle 10. At the front end of barrel 14 is its muzzle 22. At the rear end of barrel 14 is its breech 23. Receiver 12 includes an ignition mechanism such as hammer 13 for igniting powder in barrel 14.

It should be recognized that a muzzleloading rifle does not need a receiver 12 and may instead use a breech plug (not shown) in conjunction with an ignition mechanism. Examples of ignitions mechanisms include cap lock mechanisms and flint lock mechanisms.

Figure 3:
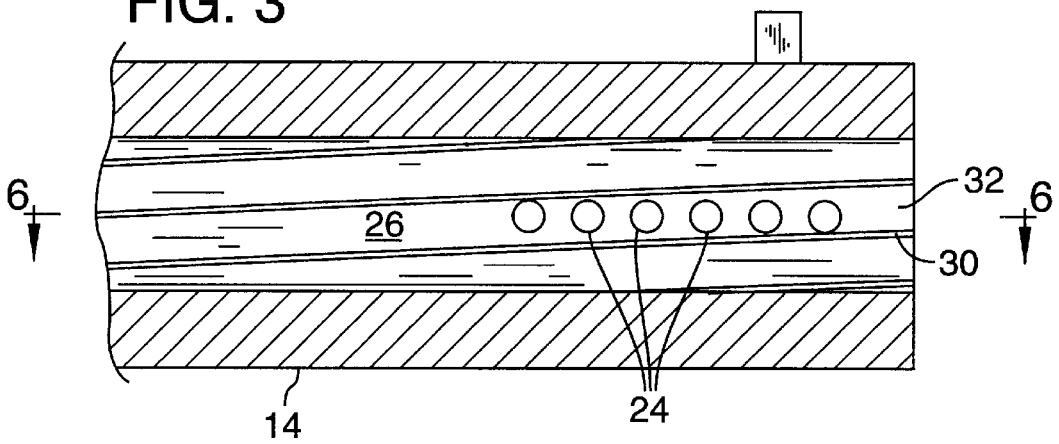
FIG. 3 is a sectional view, taken along line 3—3 of FIG. 2, of the barrel showing the relationship between the vents and the rifling.
Figure 2:
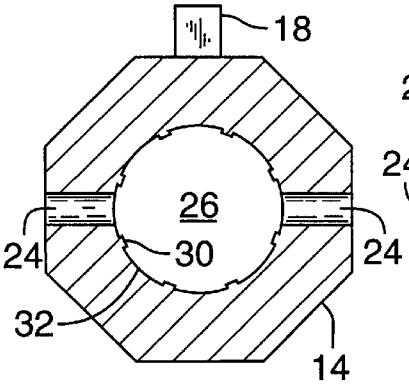
FIG. 2 is a sectional view, taken along line 2—2 of FIG. 1, of the barrel near its muzzle showing two vents.

Referring now to FIGS. 1–3, a bore 26 passes longitudinally through barrel 14. On the interior surface of barrel 14 is spiraling rifling 28, consisting of lands 30 and groves 32, which imparts a stabilizing spin to bullets fired through barrel 14. As best seen in FIG. 2, lands 30 and grooves 32 define a land diameter and a groove diameter. In the exemplary rifling 28 of barrel 14, there are eight lands 30 and grooves 32; the barrel has a nominal caliber of 0.62 inch (15.7 millimeters), with a land diameter of 0.62 in. (15.7 mm) and a groove diameter of 0.630 in. (16.0 mm).

Preferably, the width of lands 30 is quite narrow with respect to the width of grooves 32. This not only decreases the friction between rifling 28 and the bullet, but also provides for other advantages, as will become apparent later.

A plurality of vents 24 pass transversely through barrel 14 to bore 26. Vents 24 preferably are positioned on both sides of barrel 14 symmetrical to its vertical axis. A non-symmetrical arrangement would cause a sideways movement of muzzle 22 upon firing. Although any effect a sideways movement of barrel 14 may have on a bullet's point of impact could be corrected by adjusting sights 18, 20, a sideways movement of front sight 18 could delay target reacquisition after firing rifle 10, a potentially dangerous circumstance during hunting. Alternatively, a non-symmetrical arrangement may cause a vibration of barrel 14 that would be inconsistent among the shots, and thus could not be corrected by adjusting sights 18, 20.

Referring now to FIGS. 2 and 3, rifling 28 is "timed" such that vents 24 are contained entirely within rifling grooves 32. That is, no vent 24 is contained within a land 30 nor cuts the shoulder of a land 30. Since the locations of vents 24 are preferably fixed with respect to their distance from muzzle 22, the rifling 28 must be timed such that grooves 32 are properly oriented where vents 24 are located.

Furthermore, to retain the aesthetics of the muzzleloading rifle 10, the rows of vents 24 are centered on respective flats of the octagonal barrel 14. The cutaway view of FIG. 3 shows the difficulty in fitting such a centered row of vents 24 between rifling lands 30. The leftmost and rightmost vents 24 appear to be just touching the adjacent lands 30. This is only the appearance of the drawing, however. The vents 24 do not touch the lands 30.

Timing of rifling 28 can be eased by adjusting two factors: minimizing land width and rifling twist rate. As discussed above, the width of lands 30 is small relative to the width of grooves 32. In the exemplary muzzleloading rifle, the land width is 0.050 in. (1.27 mm) and the groove width is 0.200 in. (5.08 mm).

Very little spin is required to stabilize a round ball bullet. Thus a slow rate of twist, such as one turn in 144 inches (3.66 m), can be used instead of the more typical rate of one turn in 48 inches (1.22 m) or one turn in 72 inches (1.82 m). By using a very slow rate of twist, a longer row of vents 24 can be accommodated in barrel 14 without a vent 24 encroaching on a rifling land 30.

The figures show a row of six round vents 24 near muzzle 22 on each side of barrel 14. In an exemplary muzzleloading rifle, these vents 24 have a diameter of 0.125 in. (3.175 mm). It will be recognized by those of skill in the art that different numbers or shapes of vents may be used to similar effect and advantage. For example, the vents may be elongate slots.

Figure 4:
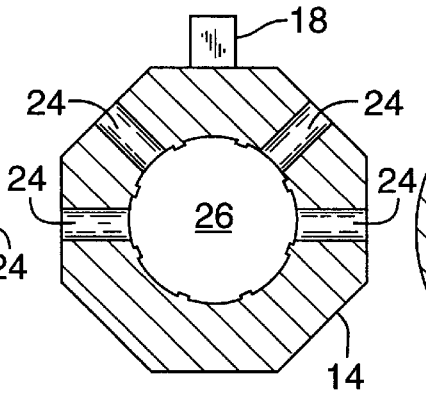
FIG. 4 is a sectional view, similar to that of FIG. 2, showing two vents or rows of vents at an angle other than horizontal on an octagonal barrel.

Referring now to FIG. 4, the rows of vents 24 need not be on a horizontal axis that bisects bore 26. The vents may be angled upward such that combustion gases will provide a downward force to counteract muzzle rise. Also, as shown in FIG. 4, barrel 14 can include more than two rows of vents 24.

To preserve the appearance of the muzzleloading rifle, the exterior opening of vents 24 are centered on the flats of octagonal barrel 14. As discussed above, locating vents 24 on the center of a flat simplifies their manufacture. A jig that defines the location of vents 24 in a straight row along the center of a flat may be used to drill vents 24.

As discussed above, it is preferable that vents 24 are arranged symmetrically about the vertical axis of barrel 14. Note that no vents have been angled downward. Muzzleloading rifles 10 use blackpowder which upon firing may not be fully consumed before exiting barrel 14. If these burning embers are directed downward, they can become a fire hazard should the shooter be standing over dry grass or leaves.

Figure 5:
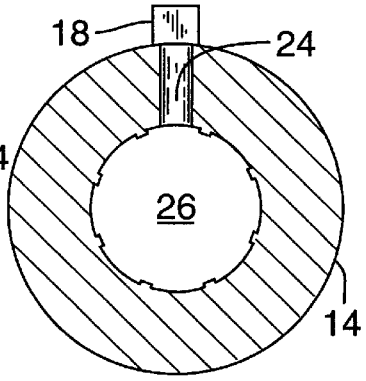
FIG. 5 is a sectional view, similar to that of FIG. 2, showing a single vent or row of vents along the top surface of the barrel.

Referring now to FIG. 5, a single vent 24 or row of vents may be used. Preferably, in the case of a single vent or row of vents, the vents would project directly upward. Unfortunately, this orientation of vents 24 results in smoke being directed into the shooter's line of sight. FIG. 5 shows the use of a barrel 14 having a circular cross section.

Figure 6:
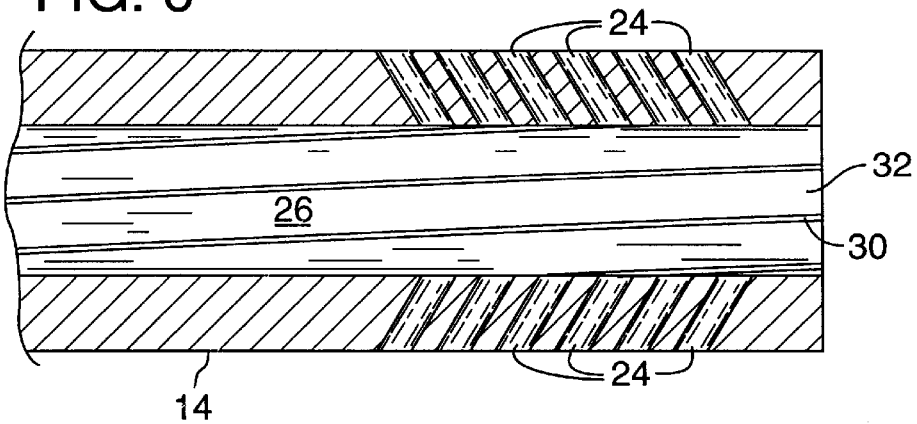
FIG. 6 is a section view, taken along line 6—6 of FIG. 3, of the barrel showing vents at an angle other than perpendicular to the axis of the barrel.

Referring now to FIG. 6, the vents can be angled other than perpendicular to the axis of barrel 14. A backward angle of about twenty or thirty degrees directs combustion gases backward, providing a resulting forward force. This forward force counteracts the backward force of recoil. In one embodiment of rifle 10, the vents 24 in the horizontal rows are angled backward while the vents 24 that angle upward are perpendicular to the axis of barrel 14.

The terms and expressions which have been employed in the foregoing specification are used therein as terms of description and not of limitation, and there is no intention, in the use of such terms and expressions, of excluding equivalents of the features shown and described or portions thereof, it being recognized the scope of the invention is defined and limited only by the claims which follow.

What is claimed is:

1. A muzzleloading rifle, comprising:

a barrel having a breech end and a muzzle end and defining a substantially cylindrical bore therebetween, said barrel having spiral rifling within said bore comprising a plurality of alternating lands and grooves, said barrel further defining a first vent through said barrel in communication with said bore, wherein said first vent enters said bore entirely within one of said grooves; and an ignition mechanism adapted to ignite a charge within said bore of said barrel.

2. The muzzleloading rifle of claim 1, wherein said first vent is aligned with a vertical axis of said barrel, where said vertical axis bisects said bore.

3. The muzzleloading rifle of claim 1, wherein said first vent is cylindrical.

4. The muzzleloading rifle of claim 1, wherein said lands are narrower than said grooves.

5. The muzzleloading rifle of claim 4, wherein said lands have a width that is narrower than one-fourth of a width of said grooves.

6. The muzzleloading rifle of claim 1, wherein said barrel further defines a second vent through said barrel in communication with said bore, wherein said second vent enters said bore entirely within one of said grooves, wherein said first and second vents are arranged symmetrically about a vertical axis of said barrel, where said vertical axis bisects said bore.

7. The muzzleloading rifle of claim 6, wherein said first and second vents are arranged on a horizontal axis of said barrel, where said horizontal axis bisects said bore.

8. The muzzleloading rifle of claim 1, wherein said barrel defines a second vent through said barrel in communication with said bore, wherein said second vent enters said bore entirely within one of said grooves, and wherein said first and second vents are arranged in a first row parallel to a longitudinal axis of said barrel.

9. The muzzleloading rifle of claim 8, wherein said first and second vents are aligned with a vertical axis of said barrel, where said vertical axis bisects said bore.

10. The muzzleloading rifle of claim 8, wherein said rifling is slower than one turn in 120 inches.

11. The muzzleloading rifle of claim 8, wherein said barrel defines a third and fourth vent through said barrel in communication with said bore, wherein said third and fourth vents enter said bore entirely within a second one of said grooves, and wherein said third and fourth vents are arranged in a second row parallel to a longitudinal axis of said barrel.

12. The muzzleloading rifle of claim 11, wherein said first and second rows are arranged symmetrically about a vertical axis of said barrel, where said vertical axis bisects said bore.

13. The muzzleloading rifle of claim 12, wherein said first and second rows are arranged on a horizontal axis of said barrel, where said horizontal axis bisects said bore.

14. A barrel for a muzzleloading rifle, comprising an elongate rod having a breech end and a muzzle end and defining a substantially cylindrical bore therebetween, said barrel having spiral rifling within said bore comprising a plurality of alternating lands and grooves, said barrel further defining a first vent through said barrel in communication with said bore, wherein said first vent enters said bore entirely within one of said grooves.

15. The barrel of claim 14, wherein said lands are narrower than said grooves.

16. The barrel of claim 15, wherein said lands have a width that is narrower than one-fourth of a width of said grooves.

17. The barrel of claim 14, wherein said barrel further defines a second vent through said barrel in communication with said bore, wherein said second vent enters said bore entirely within one of said grooves, wherein said first and second vents are arranged symmetrically about a vertical axis of said barrel, where said vertical axis bisects said bore.

18. The barrel of claim 17, wherein said first and second vents are arranged on a horizontal axis of said barrel, where said horizontal axis bisects said bore.

19. The barrel of claim 14 wherein said barrel defines a second vent through said barrel in communication with said bore, wherein said second vent enters said bore entirely within one of said grooves, and wherein said first and second vents are arranged in a first row parallel to a longitudinal axis of said barrel.

20. The barrel of claim 14, wherein said rifling is slower than one turn in 120 inches.

* * * * *